US006674225B2

(12) United States Patent
Jung

(10) Patent No.: US 6,674,225 B2
(45) Date of Patent: Jan. 6, 2004

(54) SHADOW MASK FOR FLAT CATHODE-RAY TUBE

(75) Inventor: Jin-Uk Jung, Kumi-shi (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/832,364

(22) Filed: Apr. 11, 2001

(65) Prior Publication Data

US 2002/0014820 A1 Feb. 7, 2002

(30) Foreign Application Priority Data

Apr. 11, 2000 (KR) ..... 2000-18990

(51) Int. Cl.[7] ..... H01J 29/80
(52) U.S. Cl. ..... 313/402; 313/408
(58) Field of Search ..... 313/402–408

(56) References Cited

U.S. PATENT DOCUMENTS 4,727,282 A * 2/1988 Tokita et al. ..... 313/403
4,881,004 A * 11/1989 Inoue et al. ..... 313/408
5,155,410 A * 10/1992 Wakasono et al. ..... 220/2.1 A
5,216,321 A * 6/1993 Kawamura et al. ..... 313/408
5,969,477 A * 10/1999 Haraguchi et al. ..... 313/2.1

* cited by examiner

*Primary Examiner*—Ashok Patel
*Assistant Examiner*—Anthony Perry
(74) *Attorney, Agent, or Firm*—Fleshner & Kim, LLP

(57) ABSTRACT

A shadow mask for a cathode-ray tube is provided to improve shock resistance and howling characteristics. A color cathode-ray tube including a panel whose outer surface is near flat and whose inner surface has a specific curvature, a funnel set in the rear of the panel, an electron gun set at a neck placed in the rear of the funnel, and a rectangular shadow mask placed at the inner side of the panel, having a predetermined distance from the inner surface of the panel, to select colors of electron beams emitted from the electron gun. When the radius of curvature of the longer axis of the shadow mask is Rx, the radius of curvature of its shorter axis is Ry, and the radius of curvature of its diagonal axis is Rd, these radiuses of curvature are appropriately designed to increase strength of the shadow mask.

18 Claims, 3 Drawing Sheets

【FIG. 1】
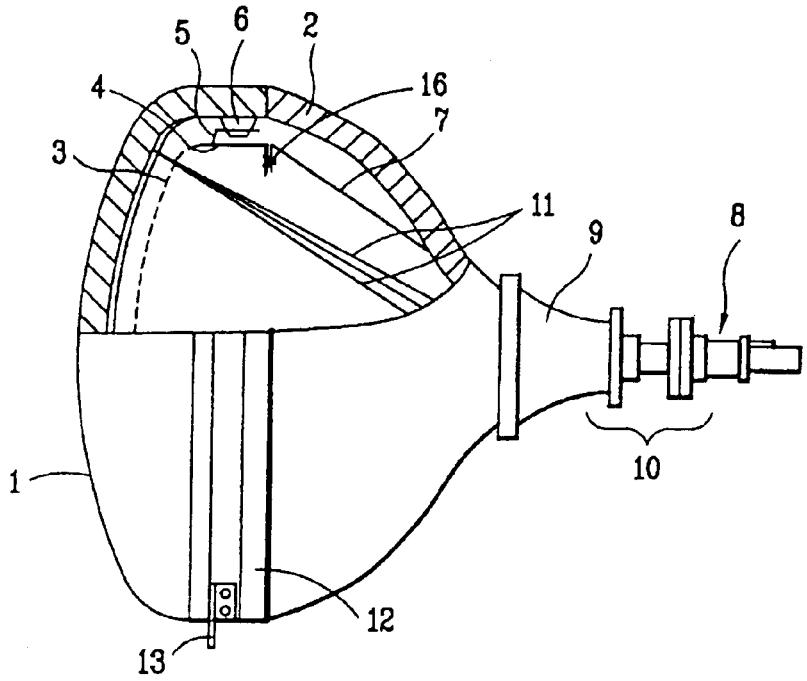
【FIG. 2】
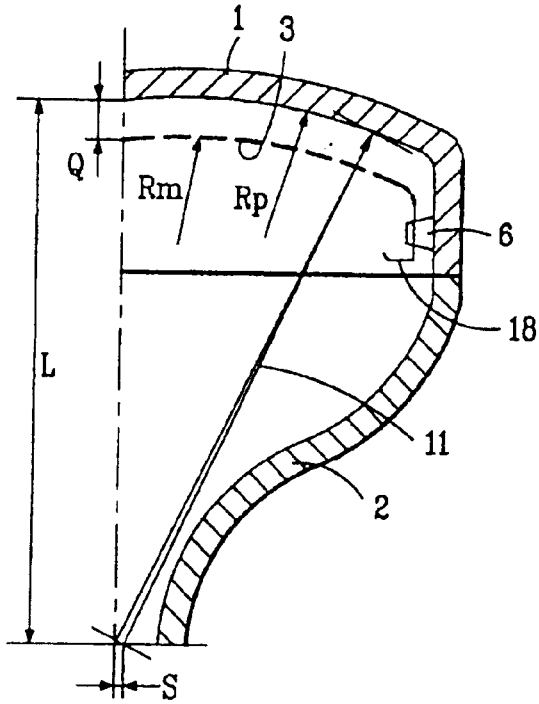

【FIG. 3】
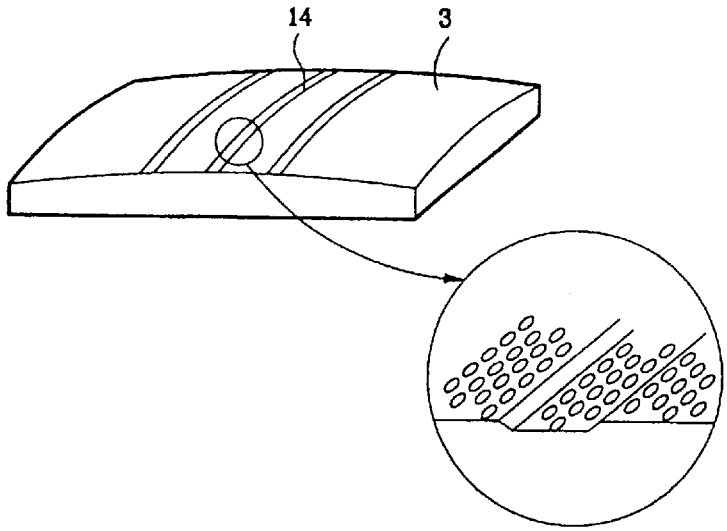
【FIG. 4】
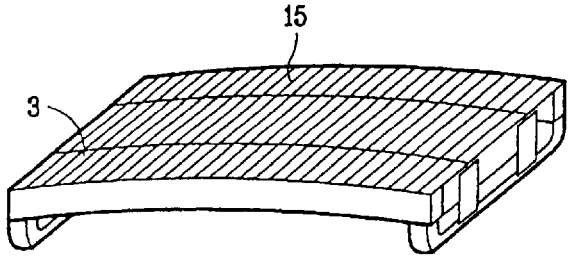
【FIG. 5】
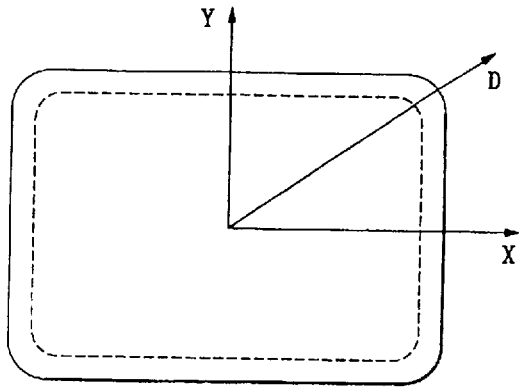

【FIG. 6】
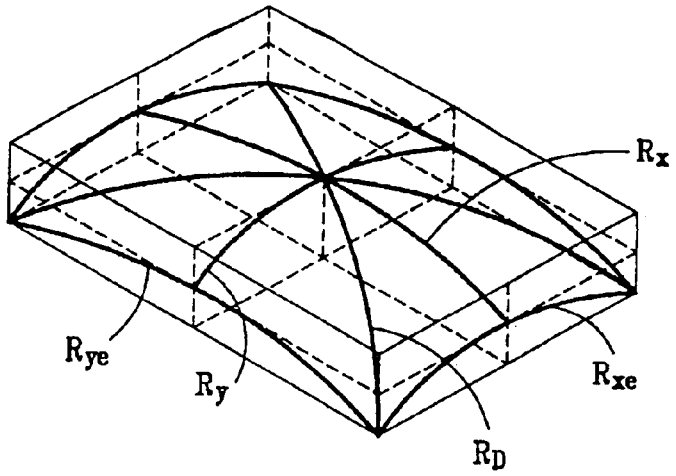
【FIG. 7a】
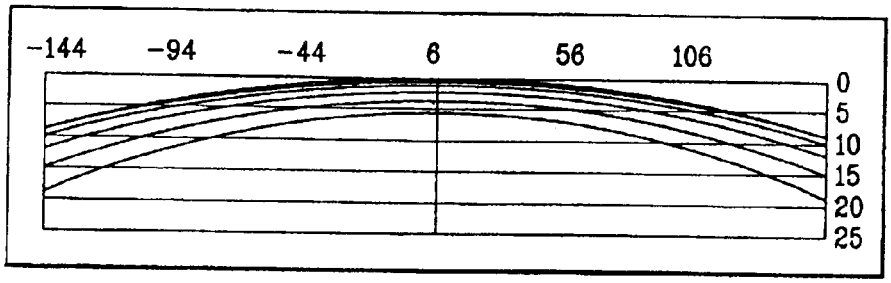
【FIG. 7b】
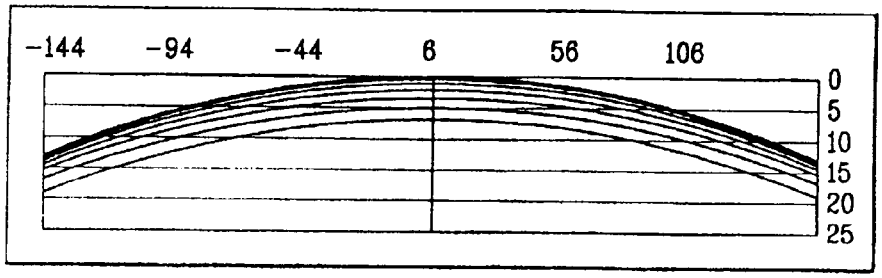

SHADOW MASK FOR FLAT CATHODE-RAY TUBE

BACKGROUND OF THE INVENTION

1. Field of the Invention

The present invention relates to a flat cathode-ray tube and, more particularly, to a curved surface structure of a shadow mask located at the inner side of a panel to select colors of electron beams to allow the electron beams to correctly impact on corresponding fluorescent materials.

2. Description of the Related Art

As shown in FIG. 1, a conventional cathode-ray tube includes a panel 1 having red, green and blue fluorescent materials coated on the inner side thereof, a funnel 2 fused to the panel 1 in the rear of the panel to maintain a vacuum state inside the cathode-ray tube, a tube-shaped neck 10 extended from the back of the funnel 2, an electron gun 8 being inserted in the neck 10 to emit electron beams 11, and a deflection yoke 9 for deflecting the electron beams. The cathode-ray tube further has a reinforcing band 12 for preventing explosion of the vacuum state therein and a lug 13 for fixing the cathode-ray tube, which are located on the outer surface thereof.

A shadow mask 3 is fixed to a frame 4 near the fluorescent materials coated on the inner surface of the panel 1. This shadow mask 3 selects colors of the electron beams emitted from the electron gun 8. The frame 4 is fit in a stud pin 6 set at the inner side wall of the panel by a support spring 5 fixed to the frame. An inner shield 7 is combined with the frame at one side of the frame 4 so that the electron beams toward the fluorescent materials are not affected by external magnetism.

The shadow mask 3 having a predetermined curvature is located at the inner side of the panel, having a predetermined distance from the inner surface of the panel. The shadow mask makes the electron beams 11 emitted from the electron gun 8 reach the red, green and blue fluorescent materials correctly. The curvature of the shadow mask is designed to allow the electron beams to have a uniform distribution corresponding to their arrangement (interval) according to the color selection characteristic. The curvature of the shadow mask is represented by grouping rate (G/R) of electron beams that determines color purity of image.

Referring to FIG. 2, the grouping rate is expressed as follows.

$$G/R=(3*S*Q)/(Ph*L) \quad (1)$$

where S is the distance between the center of the electron beams and deflection center that is a base height at which the deflection yoke deflects the electron beams, Q is the distance between the shadow mask and the inner surface of the panel, Ph is a horizontal pitch of the shadow mask, meaning the distance between holes of the shadow mask, and L is the distance between the inner surface of the panel and the deflection center.

Characteristics of the cathode-ray tube, affected by the grouping rate of the electron beams, include purity characteristic such as purity margin and direction change margin. The purity margin means a location allowance of the deflection yoke that does not allow the electron beams to make a fluorescent material at a wrong position radiate due to the location of the deflection yoke 9 so that the electron beams 11 emitted from the electron gun 8 pass through the shadow mask 3 to correctly reach the red, green and blue fluorescent materials. This purity margin facilitates a process of adjusting the screen of the cathode-ray tube.

Meantime, the path of the electron beams 11 is changed under the influence of an external magnetic field (earth magnetic field) when the location of the cathode-ray tube is turned. The direction change margin means an allowable direction change angle that prevents radiation of a fluorescent material that is not a target.

The grouping rate of the electron beams and the horizontal pitch and curvature of the shadow mask are determined based on the characteristics of the deflection yoke 9 and electron gun 8 and the curvature of the inner surface of the panel 1 to secure the purity margin and direction change margin. The shadow mask designed with regard to the grouping rate is set in the cathode-ray tube such that the red, green and blue fluorescent materials are located on the screen of the panel 1 to exactly accord with the path of the electron beams.

In the cathode-ray tube constructed as above, the radius of curvature Rm of the shadow mask is basically determined to have a predetermined ratio to the radius of curvature Rp of the inner surface of the panel for realization of images. In a recently proposed cathode-ray tube having flat outer surface, as the radius of curvature of the inner surface of the panel becomes large, the radius of curvature of the shadow mask increases to make flat. Although strength of the shadow mask is not deteriorated when the ratio of the thickness of the effective area edge of the panel to that of its center is more than 2 in the conventional cathode-ray tube, the strength of the shadow mask of the flat cathode-ray tube is abruptly lessened due to a decrease in the thickness ratio of the effective area to the center of the panel.

The deterioration in the strength of the shadow mask causes howling that generates vibration of the curved surface of the shadow mask 3 and a deterioration in shock-resistance that results in permanent transformation of the curved surface of the shadow mask due to an external strong shock applied thereto during handling of the cathode-ray tube. Furthermore, the electron beams 11 emitted from the electron gun 8 are distorted while passing through the shadow mask 3 so that they cannot strike a target fluorescent material. Accordingly, the deterioration in the strength of the shadow mask brings about flickering and a decrease in the color purity, lowering the quality of the cathode-ray tube.

To solve the above problems, indentations were formed on the shadow mask 3 to make beads 14 to improve howling characteristic, as shown in FIG. 3. Otherwise, a damper wire 15 to which tensile force is applied is set on the shadow mask 3 to disperse energy, mitigating shocks, vibrations or amplitude of sound, as shown in FIG. 4. However, the method of FIG. 3 has a difficulty in coating of fluorescent materials on the inner side of the panel during manufacturing process because the beads 14 exist in the effective area. Furthermore, the fluorescent materials coated on the panel are not uniformly distributed locally, to generate distortion of images and to make people fill uncomfortable to see the screen.

In the method shown in FIG. 4, it is required that transformation of the shadow is prevented when the shadow mask 3 to which tensile force is applied is fixed to the frame 4, and the damper wire 15 can give uniform pressure to the entire surface of the shadow mask. This complicates the manufacturing procedure and increases manufacturing cost. In addition, the aforementioned methods of forming the beads 14 in the effective area and placing the damper wire 15 have a limit with respect to the howling characteristic though they have advantages in terms of the strength of the shadow mask.

There was also proposed a method in which the thickness ratio of the effective area edge to center of the panel 1 becomes relatively large to reduce the radius of curvature of the shadow mask, thereby improving the strength of the shadow mask. However, this method also causes breakage of cathode-ray tube in thermal processes, increases material cost of the panel, and generates a difference in brightness. As a result, it cannot satisfy target resolution and target color purity and deteriorates visual flatness.

SUMMARY OF THE INVENTION

It is, therefore, an object of the present invention to provide a shadow mask of a flat cathode-ray tube, capable of satisfying a target resolution while deterioration in the structural strength thereof is prevented.

To accomplish the object of the present invention, there is provided a shadow mask for a cathode-ray tube, which is placed in the rear of a panel whose outer surface is flat and whose inner surface has a predetermined curvature to select colors of incident electron beams, in which radiuses of curvature Rx, Ry, Rxe and Rye are determined based on appropriate ratios of them to a radius of curvature Rd, and the curvature of the shadow mask is decided by a combination of the radiuses of curvature Rx, Ry, Rd, Rxe and Rye, where Rx is the radius of curvature of the longer axis passing the center of the shadow mask, Ry is the radius of curvature of the shorter axis passing the center of the shadow mask, Rd is the radius of curvature of the diagonal axis passing the center of the shadow mask, Rxe is the radius of curvature of the end of the shorter side of the shadow mask, and Rye is the radius of curvature of the end of the longer side of the shadow mask.

BRIEF DESCRIPTION OF THE DRAWINGS

FIG. 1 is a side view including a partial cross-section of a conventional cathode-ray tube;

FIG. 2 is a partial cross-sectional view illustrating an arrangement of constituent elements of the cathode-ray tube;

FIG. 3 is a perspective view illustrating a conventional howling prevention structure using beads;

FIG. 4 is a perspective view illustrating a conventional howling prevention structure using a damper wire applied to the shadow mask to which tensile force is applied;

FIG. 5 roughly illustrates the inner side of the panel and coordinates of the shadow mask for explanation of the shadow mask of the invention;

FIG. 6 roughly illustrates the radiuses of curvature of the shadow mask according to the present invention;

FIG. 7A is a graph illustrating the curvature of the conventional shadow mask; and FIG. 7B is a graph illustrating the optimized curvature of the shadow mask according to the present invention.

DETAILED DESCRIPTION OF THE PREFERRED EMBODIMENT

Reference will now be made in detail to the preferred embodiments of the present invention, examples of which are illustrated in the accompanying drawings. It should be noted in the drawings that like components are indicated by like reference numerals.

Referring to FIG. 5, the geometrical structure of the inner surface of the panel and the shadow mask can be indicated on the basis of three coordinate axes on the two-dimensional plane, that is, the longer axis (X-axis), the shorter axis (Y-axis) and the diagonal axis (D-axis). Here, the diagonal axis (D-axis) is a coordinate axis arbitrarily set for observing a variation in the curvature of the inner surface of the panel and the shadow mask, differently from the reference axes (X-axis and Y-axis).

Referring to FIG. 6, the radius of curvature of the longer axis passing the center of the shadow mask of the invention is represented by Rx, the radius of curvature of the shorter axis passing the center of the shadow mask is represented by Ry, the radius of curvature of the diagonal axis passing the center of the shadow mask is indicated by Rd, the radius of curvature of the end of the shorter side is represented by Rxe, and the radius of curvature of the end of the longer side is indicated by Rye. It can be known from FIG. 6 that each of the radiuses of curvature Rx and Ry constructing the axes of the shadow mask and the radiuses of curvature Rxe and Rye constructing the sides thereof has a height difference between the peak and both ends in the cross section thereof. A new radius of curvature of the shadow mask can be obtained by making these radiuses of curvature different from one another.

The radius of curvature Rd of the diagonal axis that is a factor deciding the height of the shadow mask is determined by the grouping rate represented by the expression (1). Thus, although it is possible to control the radius of curvature Rd of the diagonal axis to increase the height difference in order to improve the strength of the shadow mask, the radius of curvature Rd of the diagonal axis is difficult to change because it must be determined with regard to correlation of the panel and the horizontal pitch of the shadow mask that affects the resolution and color purity of the cathode-ray tube.

Accordingly, the present invention determines the radius of curvature Rd of the diagonal axis to satisfy a target panel thickness ratio and resolution and changes the radius of curvature Rx of the longer axis passing the center of the shadow mask, the radius of curvature Ry of the shorter axis passing the center of the shadow mask, the radius of curvature Rxe of the end of the shorter side and the radius of curvature Rye of the end of the longer side, to design an optimized curvature of the shadow mask. By doing so, desired strength of the shadow mask can be secured without increasing the thickness ratio of the center to edge of the panel for improving the strength of the cathode-ray tube.

To realize the target curvature of the shadow mask, five spherical surfaces are formed using the five radiuses of curvature Rx, Ry, Rd, Rxe and Rye and the five spherical surfaces are added up through the least square, to construct the optimal curvature of the shadow mask.

FIG. 7A is a graph illustrating the curvature of the conventional shadow mask, and FIG. 7B is a graph illustrating the optimized curvature of the shadow mask according to the present invention. The curved surface of the shadow mask of the invention shown in FIG. 7B has no abrupt curvature gradient owing to the five radiuses of curvature Rx, Ry, Rd, Rxe and Rye which are appropriately designed, as distinguished from the conventional super-arc curved surface shown in FIG. 7A in which the gradient of the curvature becomes larger abruptly as it goes from the center toward the side and the radius of curvature Rye of the end of the longer side and the radius of curvature Rxe of the end of the shorter side cannot be defined.

That is, the conventional super-arc curved surface has the super-arc shape even at the radiuses of curvature Rye and Rxe, and this super-arc-shaped curvature brings about a locally weak curved surface in terms of strength. However, the present invention adds the radiuses of curvature of the longer and shorter sides to define the shape of the curved surface by angles between axes. In this case, a variety of curved surfaces can be obtained in the radius of curvature of each axis and the radius of curvature of each side, enabling realization of a new curved surface of the shadow mask having no abrupt curvature gradient while maintaining excellent strength.

It is possible to compare the strength of the conventional shadow mask having the super-arc curved surface of FIG. 7A with that of the shadow mask having the new curves surface of the invention through two experimental methods. These two methods includes a method of comparing the radius of curvature of the diagonal of the shadow mask of the invention and that of the conventional shadow mask with each other, with respect to the same transformation critical acceleration value of shadow mask, and an experiment of measuring natural vibration mode and natural frequency, capable of confirming a point where the strength of the shadow mask becomes weak and numerically comparing the strengths of the conventional shadow mask and the inventive one with each other.

Table 1 represents the result obtained by comparing the curvature radius Rd of the diagonal axis the shadow mask of the invention with the conventional super-arc curved surface, which have the same transformation critical acceleration when the curvature radius of the diagonal of the cathode-ray tube panel is Rp. This experimental result shows that the curvature radius Rd of the diagonal axis of the inventive shadow mask is larger than that of the conventional one, for the same transformation limit acceleration. In addition, it is possible to define a correlation with respect to a proper ratio of the radius of curvature Rd of the diagonal axis of the inventive shadow mask to the radius of curvature Rp of the diagonal of the inner surface of the panel for a target shock resistance based on the experimental result.

TABLE 1

| Thickness ratio of panel | Rp | Conventional Rd | Inventive Rd | Transformation critical acceleration |
|---|---|---|---|---|
| 170% | 2160 mm | 1280 mm | 1654 mm | 25 G |
| 180% | 1900 mm | 1114 mm | 11492 mm | 27 G |
| 190% | 1698 mm | 934 mm | 1359 mm | 30 G |

Table 2 shows the result obtained by measuring the first-degree to tenth-degree natural frequencies of the conventional super arc curved surface and the inventive curved surface. The first-degree and second-degree natural frequencies are related with the shock-resistant characteristic. This shock-resistance is better as the frequencies are higher. The frequencies of above third degree are related with the howling and this howling characteristic becomes satisfactory as the frequencies are higher and the interval between the frequencies is larger. The table 2 shows that the frequency of the curved surface of the invention is higher than that of the conventional super arc curved surface.

TABLE 2

| | 1st | 2nd | 3rd | 4th | 5th | 6th | 7th | 8th | 9th | 10th |
|---|---|---|---|---|---|---|---|---|---|---|
| Conventional super arc | 174 | 191 | 192 | 199 | 206 | 225 | 246 | 248 | 270 | 289 |
| Present invention | 187 | 209 | 211 | 231 | 245 | 266 | 293 | 313 | 329 | 340 |

Accordingly, a relation among the radiuses of curvature Rx, Ry and Rd of the longer, shorter and diagonal axes of the shadow mask, the radiuses of curvature Rye and Rxe of the ends of the longer and shorter sides and the radius of curvature Rp of the diagonal axis of the panel, which construct the shape of curved surface optimized to the shock-resistance and howling characteristic, can be represented by the following expressions (2) to (5) on the basis of the experimental results and analyzed results.

The relation between Rx and Rd $$0.95\ Rd \leqq Rx \leqq 1.02\ Rd \quad (2)$$

The relation between Ry and Rd $$1.0*Rd \leqq Rxe \leqq 1.1*Rd \quad (3)$$

The relation between Rxe and Rd $$1.1*Rd \leqq Rxe \leqq 1.0*Rd \quad (4)$$

The relation between Rye and Rd $$0.95*Rd \leqq Rye \leqq 1.0*Rd \quad (5)$$

As shown in the expressions (2) to (5), the ranges of Rx, Ry, Rye and Rxe can be designed after fixation of the radius of curvature Rd of the diagonal axis capable of obtaining the target resolution and thickness ratio. In addition, an appropriate value with respect to each radius of curvature is determined within the ranges to realize the optimal curved surface.

Moreover, it is possible to obtain a relation between the radius of curvature Rd of the diagonal axis of the shadow mask and the radius of curvature Rp of the diagonal axis of the inner surface of the panel through the experiment obtaining the result of table 1, as shown in the following expression (6).

$$2/3\ Rp \leqq Rd \leqq 4/5\ Rp \quad (6)$$

As described above, the radiuses of curvature Rye and Rxe of the ends of the longer and shorter sides are determined such that the shape of curved surface can be defined by angles between the axes. In this case, it is possible to realize a variety of curved surface shapes with respect to the radius of curvature of each axis and the radius of curvature of each side of the shadow mask. The curved surface constructed as above has excellent shock-resistance and howling characteristics compared to the conventional super arc curved surface.

Specifically, when external shock is applied to the cathode-ray tube, external energy is delivered to the shadow mask through a spring combined with the panel. This shock is applied unspecifically to the shadow mask and concentrically transforms a local vulnerable portion thereof. Because of this characteristic, shocks in all directions are checked in a shock resistance test. Here, it is required that the transformation does not occur in any direction.

In case of the conventional super arc curved surface, however, when an external shock is applied thereto only in the direction of axis of the cathode-ray tube, its center becomes weak relatively although its strength is maintained at the edge thereof. Furthermore, the conventional super arc curved surface is vulnerable to shocks applied thereto in unspecified directions. Accordingly, shock resistance similar to that of the conventional cathode-ray tube having convex outer surface can be obtained only when a curvature with a sufficient margin, that is, a specific height difference between the center and corner of the shadow mask must be secured in order to cope with the unspecified-directional shocks.

The curved surface constructed based on the curvature values of the present invention can make uniform strength over the overall surface of the shadow mask and maintain the same characteristic for unspecified-directional shocks applied thereto. Moreover, the cathode-ray tube whose outer surface is flat, to which the curved surface of the shadow mask according to the present invention is applied, is not required to have the height difference between the center and corner of the shadow mask. Accordingly, the panel thickness ratio and the horizontal pitch are not increased so that resolution is not deteriorated.

Meantime, the howling phenomenon is usually generated at the side than its center. Because the howling is concentrically created in local vulnerable points in the shadow mask, it is important to remove vulnerable points of the curved surface in designing of the curved surface. Furthermore, the frequency band of sound wave transmitted through a speaker is 50–1000 Hz so that probability of generation of howling increases when the natural frequency of the shadow mask is distributed in a specific frequency band. The bandwidth of the natural frequency of above third-degree of the curved surface of the invention is distributed widely more than the bandwidth of the conventional super arc curved surface so that the inventive shadow mask can decreases the probability of generation of howling. Thus, the curved surface of the present invention has excellent howling characteristic.

Meanwhile, in a shock experiment performed for Rp=2160 mm, the critical acceleration value generating transform of the shadow mask is 25 G in case of the present invention while 20 G in the prior art. This means that there is an improvement of 5 G approximately in the critical acceleration in case of the present invention. In addition, the curved surface according to the present invention improves color purity more than one grade compared with the conventional one, with respect to external sound waves.

As described above, the curvature structure of the curved surface of the shadow mask according to the present invention is defined by the radiuses of curvature Rx, Ry and Rd of the longer axis, shorter axis and diagonal axis and the radiuses of curvature Rye and Rxe of the ends of the longer and shorter sides, and each of the radiuses of curvature is varied to construct the optimal shadow mask curved surface, thereby minimizing the thickness ratio of the center to the margin of the panel in the cathode-ray tube. Furthermore, the shock resistance and howling characteristics of the shadow mask of the flat cathode-ray tube can be improved without deteriorating quality of the cathode-ray tube.

Although specific embodiments including the preferred embodiment have been illustrated and described, it will be obvious to those skilled in the art that various modifications may be made without departing from the spirit and scope of the present invention, which is intended to be limited solely by the appended claims.

What is claimed is:

1. A cathode-ray tube including a panel whose outer surface is substantially flat and whose inner surface has a specific curvature, a funnel set in a rear of the panel, an electron gun set at a neck placed in a rear of the funnel, and a rectangular shadow mask having a predetermined curvature greater than zero and placed at an inner side of the panel a predetermined distance from an inner surface of the panel, to select colors of electron beams emitted from the electron gun, wherein the following expressions are satisfied when a radius of curvature of a longer axis passing a center of the shadow mask is Rx, a radius of curvature of shorter axis passing the center of the shadow mask is Ry, and a radius of curvature of a diagonal axis passing the center of the shadow mask is Rd $$0.95*Rd \leqq Rx \leqq 1.0*Rd$$

$$1.0*Rd \leqq Ry \leqq 1.05*Rd.$$

2. The cathode-ray tube as claimed in claim 1, wherein the following expressions are satisfied when a radius of curvature of an end of a shorter side of the shadow mask is Rxe and a radius of curvature of an end of a longer side of the shadow mask is Rye $$1.0*Rd \leqq Rxe \leqq 1.1*Rd$$

$$0.95*Rd \leqq Rye \leqq \leqq 1.0*Rd.$$

3. The cathode-ray tube as claimed in claim 1, wherein, when the radius of curvature of the diagonal of the panel is defined as Rp, the radius of curvature Rd of the diagonal axis of the shadow mask is larger than or identical to ⅔Rp and smaller than or identical to ⅘Rp.

4. The cathode-ray tube as claimed in claim 1, wherein the cathode-ray tube is a color cathode-ray tube.

5. A cathode-ray tube, comprising:

a panel having a substantially flat outer surface and an inner surface having a predetermined curvature;

a funnel positioned at a rear of the panel;

an electron gun positioned in a neck portion of the funnel; and a shadow mask having a predetermined curvature greater than zero and positioned at an inner side of the panel a predetermined distance from the inner surface of the panel and configured to select colors of electron beams emitted from the electron gun, wherein the shadow mask satisfies the following equations:

$$0.95*Rd \leqq Rx \leqq 1.0*Rd$$

$$1.0*Rd \leqq Ry \leqq 1.05*Rd$$

where Rx is a radius of curvature of a longer axis passing a center of the shadow mask, Ry is a radius of curvature of a shorter axis passing the center of the shadow mask, and Rd is a radius of curvature of a diagonal axis passing the center of the shadow mask.

6. The cathode-ray tube as claimed in claim 5, wherein the shadow mask is substantially rectangular.

7. The cathode-ray tube as claimed in claim 5, wherein the shadow mask satisfies the following equations:

$$1.0*Rd \leqq Rxe \leqq 1.1*Rd$$

$$0.95*Rd \leqq Rye \leqq 1.0*Rd$$

where Rxe is a radius of curvature of an end of a shorter side of the shadow mask and Rye is a radius of curvature of an end of a longer side of the shadow mask.

8. The cathode-ray tube as claimed in claim 5, wherein, when a radius of curvature of a diagonal axis of the inner surface of the panel is defined as Rp, the radius of curvature Rd of the diagonal axis of the shadow mask is larger than or identical to ⅔Rp and smaller than or identical to ⅘Rp.

9. The cathode-ray tube as claimed in claim 5, wherein the cathode-ray tube is a color cathode-ray tube.

10. An improved shadow mask for a cathode-ray tube including a panel having a substantially flat outer surface and an inner surface having a predetermined curvature; a funnel positioned at a rear of the panel; an electron gun positioned in a neck portion of the funnel; and a shadow mask having a predetermined curvature greater than zero and positioned at an inner side of the panel a predetermined distance from the inner surface of the panel and configured to select colors of electron beams emitted from the electron gun, wherein the improved shadow mask satisfies the following equations:

$$0.95*Rd \leqq Rx \leqq 1.0*Rd$$

$$1.0*Rd \leqq Ry \leqq 1.05*Rd$$

where Rx is a radius of curvature of a longer axis passing a center of the shadow mask, Ry is a radius of curvature of a shorter axis passing the center of the shadow mask, and Rd is a radius of curvature of a diagonal axis passing the center of the shadow mask.

11. The improved shadow mask as claimed in claim 10, wherein the shadow mask is substantially rectangular.

12. The improved shadow mask as claimed in claim 10, wherein the shadow mask satisfies the following equations:

$$1.0*Rd \leqq Rxe \leqq 1.1*Rd$$

$$0.95*Rd \leqq Rye \leqq 1.0*Rd$$

where a Rxe radius of curvature of an end of a shorter side of the shadow mask and Rye is a radius of curvature of an end of a longer side.

13. The improved shadow mask as claimed in claim 10, wherein, when a radius of curvature of a diagonal axis of the inner surface of the panel is defined as Rp, the radius of curvature Rd of the diagonal axis of the shadow mask is larger than or identical to ⅔Rp and smaller than or identical to ⅘Rp.

14. The improved shadow mask as claimed in claim 10, wherein the shadow mask is configured for a color cathode-ray tube.

15. A cathode-ray tube including a panel whose outer surface is near flat and whose inner surface has a specific curvature, a funnel set in the rear of the panel, an electron gun set at a neck placed in the rear of the funnel, and a rectangular shadow mask placed at the inner side of the panel, having a predetermined distance from the inner surface of the panel, to select colors of electron beams emitted from the electron gun, wherein the following expressions are satisfied when the radius of curvature of the longer axis passing the center of the shadow mask is Rx, the radius of curvature of its shorter axis passing the center of the shadow mask is Ry, and the radius of curvature of its diagonal axis passing the center of the shadow mask is Rd:

$$0.95*Rd \leqq Rx \leqq 1.0*Rd$$

$$1.0*Rd \leqq Ry \leqq 1.05*Rd$$

wherein, when the radius of curvature of the diagonal of the panel is defined as Rp, the radius of curvature Rd of the diagonal axis of the shadow mask is larger than or identical to ⅔Rp and smaller than or identical to ⅘Rp.

16. The cathode-ray tube as claimed in claim 15, wherein the shadow mask satisfies the following equations:

$$1.0*Rd \leqq Rxe \leqq 1.1*Rd$$

$$0.95*Rd \leqq Rye \leqq 1.0*Rd$$

where Rxe is a radius of curvature of an end of a shorter side of the shadow mask and Rye is a radius of curvature of an end of a longer side of the shadow mask.

17. The cathode-ray tube as claimed in claim 15, wherein the cathode-ray tube is a color cathode-ray tube.

18. The cathode-ray tube as claimed in claim 15, wherein Rd>0.0.

* * * * *